US007597150B2

(12) United States Patent
Clem

(10) Patent No.: US 7,597,150 B2
(45) Date of Patent: Oct. 6, 2009

(54) WATER SENSITIVE ADAPTIVE INFLOW CONTROL USING CAVITATIONS TO ACTUATE A VALVE

(75) Inventor: Nicholas J. Clem, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 12/024,658

(22) Filed: Feb. 1, 2008

(65) Prior Publication Data

US 2009/0194289 A1 Aug. 6, 2009

(51) Int. Cl.
*E21B 34/06* (2006.01)

(52) U.S. Cl. ..... 166/334.4; 166/369; 166/373; 166/386

(58) Field of Classification Search ..... 166/369, 166/250.15, 373, 386, 334.4, 319
See application file for complete search history.

(56) References Cited

U.S. PATENT DOCUMENTS

| | | | |
|---|---|---|---|
| 1,362,552 | A | 12/1920 | Alexander et al. |
| 1,649,524 | A | 11/1927 | Hammond |
| 1,984,741 | A | 12/1934 | Harrington |
| 2,089,477 | A | 8/1937 | Halbert |
| 2,214,064 | A | 9/1940 | Niles |
| 2,257,523 | A | 9/1941 | Combs |
| 2,412,841 | A | 12/1946 | Spangler |
| 2,762,437 | A | 9/1956 | Egan et al. |
| 2,810,352 | A | 10/1957 | Tumilson |
| 3,385,367 | A | 5/1968 | Kollsman |
| 3,451,477 | A | 6/1969 | Kelley |
| 3,675,714 | A | 7/1972 | Thompson |

(Continued)

FOREIGN PATENT DOCUMENTS

| | | |
|---|---|---|
| CN | 1385594 | 12/2002 |

(Continued)

OTHER PUBLICATIONS

Optimization of Commingled Production Using Infinitely Variable Inflow Control Valves; M.M, J. J. Naus, Delft University of Technology (DUT), Shell International Exploration and production (SIEP); J.D. Jansen, DUT and SIEP; SPE Annual Technical Conference and Exhibition, Sep. 26-29 Houston, Texas, 2004, Society of Patent Engineers.

(Continued)

*Primary Examiner*—Jennifer H Gay
*Assistant Examiner*—Elizabeth C Gottlieb
(74) *Attorney, Agent, or Firm*—Mossman Kumar & Tyler PC

(57) ABSTRACT

An apparatus for controlling fluid flow between a wellbore tubular and a wellbore annulus includes a passage between a bore of the wellbore tubular and the wellbore annulus. The passage causes cavitations in a flowing fluid made up of mostly water. The cavitations activate a flow control device that controls fluid flow into the wellbore tubular. In one method, the flow control device includes a pressure chamber pressurized by high-pressure fluid associated with the cavitations. The pressure in the pressure chamber actuates a piston assembly coupled to a closure element that restricts fluid flow into the wellbore tubular. Alternatively, a power generator generates an electrical signal in response to the cavitations and transmits the electrical signal to the flow control device. In response to the electrical signal, the flow control element activates one or more devices that move a closure element to restrict fluid flow into the wellbore tubular.

20 Claims, 5 Drawing Sheets

U.S. PATENT DOCUMENTS

| | | | | |
|---|---|---|---|---|
| 3,739,845 | A | | 6/1973 | Berry et al. |
| 3,791,444 | A | | 2/1974 | Hickey |
| 3,951,338 | A | | 4/1976 | Genna |
| 4,173,255 | A | | 11/1979 | Kramer |
| 4,287,952 | A | | 9/1981 | Erbstoesser |
| 4,491,186 | A | | 1/1985 | Alder |
| 4,497,714 | A | | 2/1985 | Harris |
| 4,572,295 | A | | 2/1986 | Walley |
| 4,614,303 | A | * | 9/1986 | Moseley et al. ..... 239/499 |
| 4,974,674 | A | | 12/1990 | Wells |
| 4,998,585 | A | | 3/1991 | Newcomer et al. |
| 5,333,684 | A | | 8/1994 | Walter et al. |
| 5,337,821 | A | | 8/1994 | Peterson |
| 5,431,346 | A | * | 7/1995 | Sinaisky ..... 239/399 |
| 5,435,393 | A | | 7/1995 | Brekke et al. |
| 5,435,395 | A | | 7/1995 | Connell |
| 5,597,042 | A | | 1/1997 | Tubel et al. |
| 5,609,204 | A | | 3/1997 | Rebardi et al. |
| 5,673,751 | A | | 10/1997 | Head et al. |
| 5,803,179 | A | | 9/1998 | Echols |
| 5,831,156 | A | | 11/1998 | Mullins |
| 5,873,410 | A | | 2/1999 | Iato et al. |
| 5,881,809 | A | | 3/1999 | Gillespie et al. |
| 5,982,801 | A | * | 11/1999 | Deak ..... 372/69 |
| 6,068,015 | A | | 5/2000 | Pringle |
| 6,112,815 | A | | 9/2000 | Boe et al. |
| 6,112,817 | A | | 9/2000 | Voll |
| 6,253,861 | B1 | | 7/2001 | Carmichael et al. |
| 6,273,194 | B1 | | 8/2001 | Hiron |
| 6,305,470 | B1 | | 10/2001 | Woie |
| 6,367,547 | B1 | | 4/2002 | Towers et al. |
| 6,371,210 | B1 | | 4/2002 | Bode et al. |
| 6,505,682 | B2 | | 1/2003 | Brockman |
| 6,516,888 | B1 | | 2/2003 | Gunnerson et al. |
| 6,622,794 | B2 | | 9/2003 | Zisk |
| 6,635,732 | B2 | | 10/2003 | Mentak |
| 6,667,029 | B2 | | 12/2003 | Zhong et al. |
| 6,679,324 | B2 | | 1/2004 | Boer et al. |
| 6,692,766 | B1 | | 2/2004 | Rubinstein et al. |
| 6,699,503 | B1 | | 3/2004 | Sako et al. |
| 6,699,611 | B2 | | 3/2004 | Kim et al. |
| 6,786,285 | B2 | | 9/2004 | Johnson et al. |
| 6,817,416 | B2 | | 11/2004 | Wilson et al. |
| 7,185,706 | B2 | | 3/2007 | Freyer |
| 2002/0125009 | A1 | | 9/2002 | Wetzel et al. |
| 2004/0052689 | A1 | | 3/2004 | Yao |
| 2004/0144544 | A1 | | 7/2004 | Freyer |
| 2005/0016732 | A1 | | 1/2005 | Brannon et al. |
| 2005/0171248 | A1 | | 8/2005 | Li et al. |
| 2005/0189119 | A1 | | 9/2005 | Gynz-Rekowski |
| 2006/0086498 | A1 | * | 4/2006 | Wetzel et al. ..... 166/250.12 |
| 2008/0236839 | A1 | * | 10/2008 | Oddie ..... 166/373 |

FOREIGN PATENT DOCUMENTS

| | | |
|---|---|---|
| GB | 1492345 | 11/1977 |
| GB | 2341405 | 12/2007 |
| WO | 9403743 A1 | 2/1994 |
| WO | WO 00/79097 | 5/2000 |
| WO | WO 01/65063 | 2/2001 |
| WO | WO 01/77485 | 3/2001 |
| WO | WO 02/075110 | 9/2002 |
| WO | WO 2006/015277 | 7/2005 |

OTHER PUBLICATIONS

An Oil Selective Inflow Control System; Rune Freyer, Easy Well Solutions; Morten Fejerskkov, Norsk Hydro; Arve Huse, Altinex; European Petroleum Conference, Oct. 29-31, Aberdeen, United Kingdom, Copyright 2002, Society of Petroleum Engineers, Inc.

Determination of Perforation Schemes to Control Production and Injection Profiles Along Horizontal; Asheim, Harald, Norwegian Institute of Technology; Oudeman, Pier, Koninklijke/Shell Exploratie en Producktie Laboratorium; SPE Drilling & Completion, vol. 12, No. 1, March; pp. 13-18; 1997 Society of Petroleum Engineers.

Restarick, Henry; Horizontal Completion Options in Reservoirs With Sand Problems; Halliuburton Energy Services; SPE 29831, Copyright 1995; Society of Petroleum Engineers Inc.

Dikken, Ben J.; Pressure Drip in Horizontal Wells and Its Effect on Production Performance; SPE, Koninklijke/Shell E&P Laboratorium; Nov. 1990.

"Rapid Swelling and Deswelling of Thermoreversible Hydrophobically Modified Poly(N-Isopropylacrylamide) Hydrogels Prepared by Freezing Polymerisation", Xue, W., Hamley, I. W. and Huglin, M. B., 2002, 43(1) 5181-5186.

"Thermoreversible Swelling Behavior of Hydrogels Based on N-Isopropylacrylamide with a Zwitterionic Comonomer". Xue, W., Champ, S. amd Huglin, M. B. 2001, European Polymer Journal, 37(5) 869-875.

Dinarvand, R., D'Emanuele, A (1995) The use of thermoresponsive hydrogels for an-off release of molecules, J. Control. Rel. 36: 221-227.

Tanaka, T., Nishio, I., Sun, S.T., Ueno-Nisho, S. (1982) Collapse of gels in an electric field, Science. 218:467-469.

Ishihara,K., Hamada, N., Sato, S., Shinohara, I., (1984) Photoinduced serlling control of amphiphdilic azoaromatic polymer membrane. J. Polym. Sci., Polym. Chem. Ed. 22: 121-128.

Ricka, J. Tanaka, T. (1984) Swelling of Ionic gels: Quantitative performance of the Donnan Thory, Macromolecules, 17:2916-2921.

Stephen P. Mathis, Baker Oil Tools, SPE; "Sand Management: A Review of Approaches and Concerns; SPE 82240"; Presented at the SPE European Formation Damage Conference, Hague, The Netherlands May 13-14, 2003; Copyright 2003, Society of Petroleum Engineers Inc.

E. Paul Bercegeay, University of Southwestern Louisiana; Charles A. Richard, Baker Oil Tools, Inc. Member AIME; "A One-Trip Gravel Packing System, SPE 4771"; Prepared for the Society of Petroleum Engineers of AIME Symposium on Formation Damage Control, New Orleans, La., Feb. 7-8, 1974; Copyright 1974, American Institute of Mining, Metallurgical and Petroleum Engineers, Inc.

* cited by examiner

WATER SENSITIVE ADAPTIVE INFLOW CONTROL USING CAVITATIONS TO ACTUATE A VALVE

CROSS-REFERENCE TO RELATED APPLICATIONS

BACKGROUND OF THE DISCLOSURE

1. Field of the Disclosure

The disclosure relates generally to systems and methods for selective control of fluid flow into a production string in a wellbore.

2. Description of the Related Art

Hydrocarbons such as oil and gas are recovered from a subterranean formation using a wellbore drilled into the formation. Such wells are typically completed by placing a casing along the wellbore length and perforating the casing adjacent each such production zone to extract the formation fluids (such as hydrocarbons) into the wellbore. These production zones are sometimes separated from each other by installing a packer between the production zones. Fluid from each production zone entering the wellbore is drawn into a tubing that runs to the surface. It is desirable to have substantially even drainage along the production zone. Uneven drainage may result in undesirable conditions such as an invasive gas cone or water cone. In the instance of an oil-producing well, for example, a gas cone may cause an inflow of gas into the wellbore that could significantly reduce oil production. In like fashion, a water cone may cause an inflow of water into the oil production flow that reduces the amount and quality of the produced oil. Accordingly, it is desired to provide even drainage across a production zone and/or the ability to selectively close off or reduce inflow within production zones experiencing an undesirable influx of water and/or gas.

The present disclosure addresses these and other needs of the prior art.

SUMMARY OF THE DISCLOSURE

In aspects, the present disclosure provides an apparatus for controlling a flow of fluid between a wellbore tubular and a wellbore annulus. The apparatus may include a passage formed in a body that provides fluid communication between a bore of the wellbore tubular and the wellbore annulus. The passage may be configured to cause cavitations in a flowing fluid by accelerating and decelerating the flowing fluid. In embodiments, the passage may include a converging portion and a diverging portion. The cavitations may be used to activate a flow control device that controls fluid flow into the wellbore tubular. In one arrangement, the flow control device may include a pressure chamber configured to receive a high-pressure fluid associated with the cavitations. A valve associated with the pressure chamber may be configured to open in response to the cavitations in order to increase or build up pressure in the pressure chamber. The built-up pressure in the pressure chamber may be used to actuate a piston assembly coupled to a closure element. When actuated, the piston assembly may move the closure element between an open position and a closed position. In another arrangement, a power generator may be configured to generate an electrical signal in response to the cavitations and transmit the electrical signal to the flow control device.

In aspects, the present disclosure provides a method for controlling a flow of fluid between a bore of a wellbore tubular and a wellbore annulus. The method may include controlling fluid flow into the wellbore tubular bore using a flow control device; and activating the flow control device using cavitations generated in a flowing fluid. The method may further include configuring a passage between the wellbore tubular bore and the wellbore annulus to cause the cavitations. In one arrangement, the method includes accelerating and decelerating a flowing fluid to cause the cavitations. The method may further include increasing a pressure in a pressure chamber using the cavitations; and controlling the pressure in the pressure chamber using a valve that opens in response to the cavitations. In another arrangement, the method may include generating an electrical signal in response to the cavitations and transmitting the electrical signal to the flow control device.

In aspects, the present disclosure provides a system for controlling a flow of fluid in a well. The system may include a wellbore tubular configured to convey fluid from a formation to the surface; and an in-flow control device configured to control fluid flow between the formation and a bore of the wellbore tubular. A passage formed in the in-flow control device may be configured to cause cavitations in a flowing fluid. The system may include a flow control device that is activated by the cavitations and that is configured to control fluid flow into the wellbore tubular bore. In embodiments, the passage may include a first portion configured to accelerate a flowing fluid and a second portion configured to decelerate the flowing fluid. In embodiments, the passage may be configured to cause cavitations when the flowing fluid is substantially water and to not cause cavitations when the flowing fluid is substantially a hydrocarbon. In one arrangement, the flow control device includes a pressure chamber configured to receive a high-pressure fluid associated with the cavitations; a piston assembly actuated by a pressure in the pressure chamber; and a closure member displaced by the piston assembly. In another embodiment, the system may include a power generator configured to generate an electrical signal in response to the cavitations and transmit the electrical signal to the flow control device.

It should be understood that examples of the more important features of the disclosure have been summarized rather broadly in order that detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

The advantages and further aspects of the disclosure will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION OF THE PREFERRED EMBODIMENTS

Figure 1:
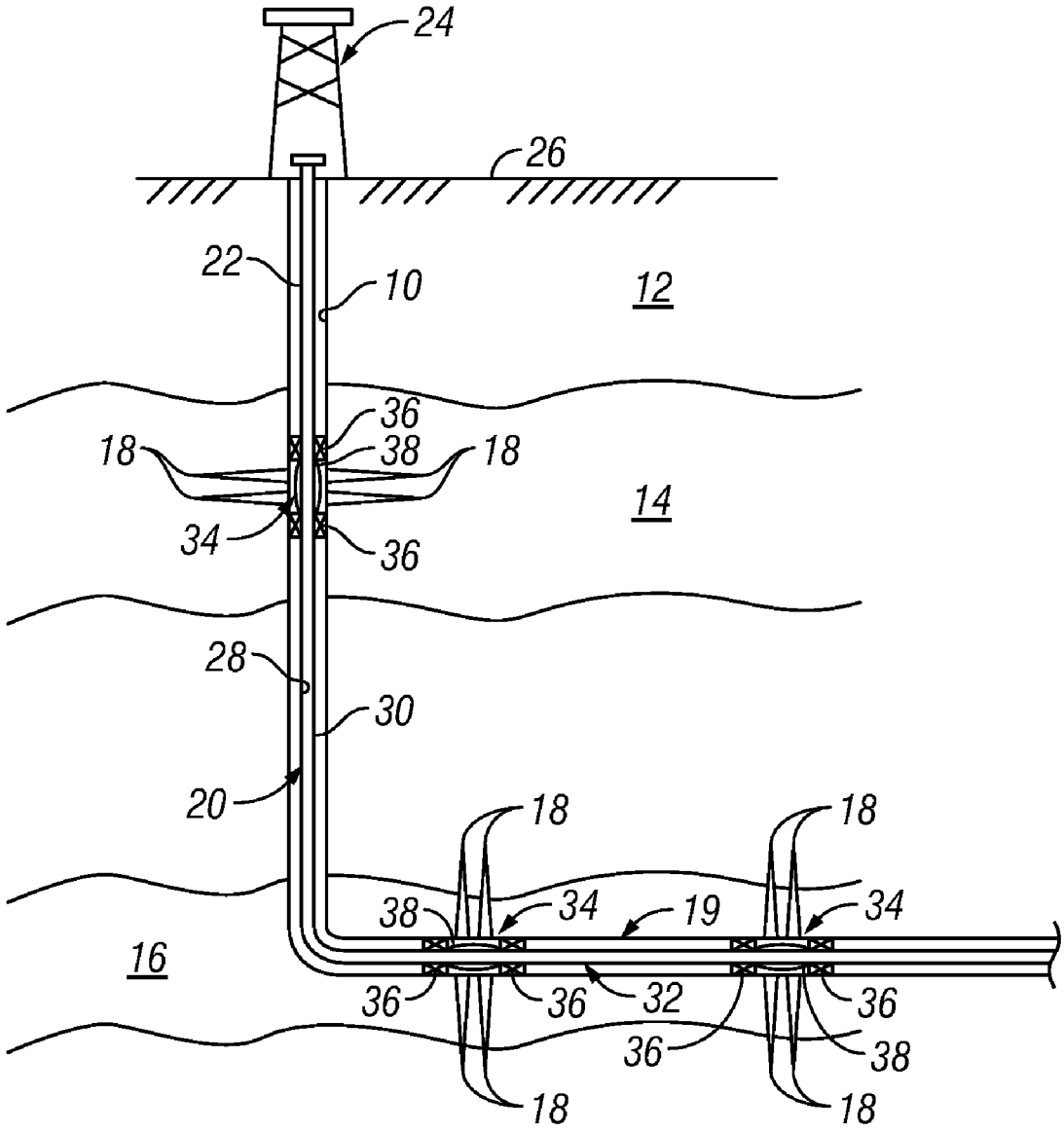
FIG. 1 is a schematic elevation view of an exemplary multi-zonal wellbore and production assembly which incorporates an inflow control system in accordance with one embodiment of the present disclosure.

The present disclosure relates to devices and methods for controlling production of a hydrocarbon producing well. In aspects, these devices and methods may utilize venturi passages that are configured to induce cavitations in a flow of water. The energy associated with these cavitations is harnessed to either directly or indirectly energize a flow control element that restricts the flow of the water into a bore of a wellbore tubular. The present disclosure is susceptible to embodiments of different forms. There are shown in the drawings, and herein will be described in detail, specific embodiments of the present disclosure with the understanding that the present disclosure is to be considered an exemplification of the principles of the disclosure and is not intended to limit the disclosure to that illustrated and described herein. Further, while embodiments may be described as having one or more features or a combination of two or more features, such a feature or a combination of features should not be construed as essential unless expressly stated as essential.

Referring initially to FIG. 1, there is shown an exemplary wellbore 10 that has been drilled through the earth 12 and into a pair of formations 14, 16 from which it is desired to produce hydrocarbons. The wellbore 10 is cased by metal casing, as is known in the art, and a number of perforations 18 penetrate and extend into the formations 14, 16 so that production fluids may flow from the formations 14, 16 into the wellbore 10. The wellbore 10 has a deviated or substantially horizontal leg 19. The wellbore 10 has a late-stage production assembly, generally indicated at 20, disposed therein by a tubing string 22 that extends downwardly from a wellhead 24 at the surface 26 of the wellbore 10. The production assembly 20 defines an internal axial flowbore 28 along its length. An annulus 30 is defined between the production assembly 20 and the wellbore casing. The production assembly 20 has a deviated, generally horizontal portion 32 that extends along the deviated leg 19 of the wellbore 10. Production devices 34 are positioned at selected points along the production assembly 20. Optionally, each production device 34 is isolated within the wellbore 10 by a pair of packer devices 36. Although only two production devices 34 are shown in FIG. 1, there may, in fact, be a large number of such devices arranged in serial fashion along the horizontal portion 32.

Each production device 34 features a production control device 38 that is used to govern one or more aspects of a flow of one or more fluids into the production assembly 20. As used herein, the term "fluid" or "fluids" includes liquids, gases, hydrocarbons, multi-phase fluids, mixtures of two of more fluids, water, brine, engineered fluids such as drilling mud, fluids injected from the surface such as water, and naturally occurring fluids such as oil and gas. In accordance with embodiments of the present disclosure, the production control device 38 may have a number of alternative constructions that ensure selective operation and controlled fluid flow therethrough.

Figure 2:
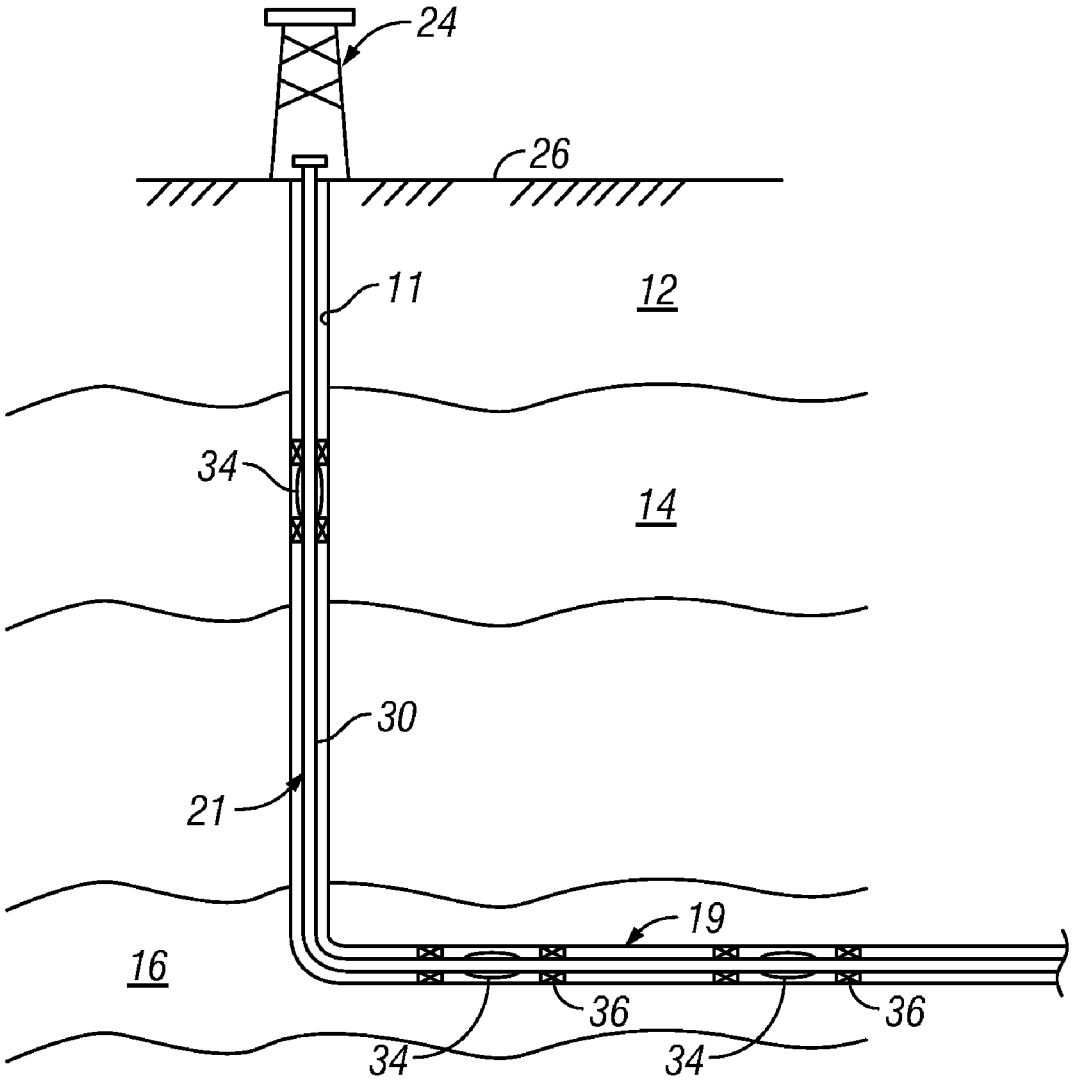
FIG. 2 is a schematic elevation view of an exemplary open hole production assembly which incorporates an inflow control system in accordance with one embodiment of the present disclosure.

FIG. 2 illustrates an exemplary open hole wellbore arrangement 11 wherein the production devices of the present disclosure may be used. Construction and operation of the open hole wellbore 11 is similar in most respects to the wellbore 10 described previously. However, the wellbore arrangement 11 has an uncased borehole that is directly open to the formations 14, 16. Production fluids, therefore, flow directly from the formations 14, 16, and into the annulus 30 that is defined between the production assembly 21 and the wall of the wellbore 11. There are no perforations, and open hole packers 36 may be used to isolate the production control devices 38. The nature of the production control device is such that the fluid flow is directed from the formation 16 directly to the nearest production device 34, hence resulting in a balanced flow. In some instances, packers maybe omitted from the open hole completion.

Figure 3:
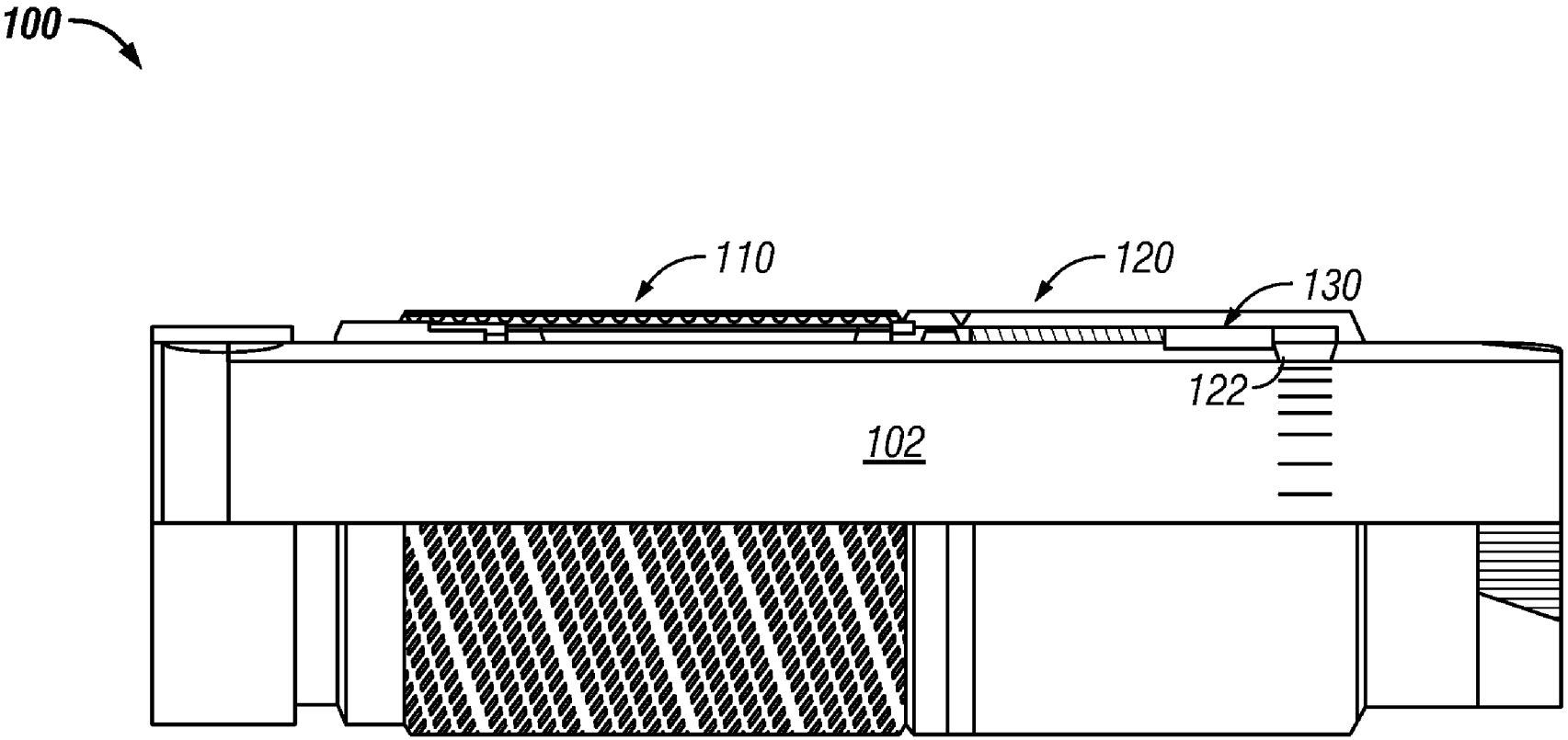
FIG. 3 is a schematic cross-sectional view of an exemplary production control device made in accordance with one embodiment of the present disclosure.

Referring now to FIG. 3, there is shown one embodiment of a production control device 100 for controlling the flow of fluids from a reservoir into a flow bore 102 of a wellbore tubular (e.g., tubing string 22 of FIG. 1). This flow control may be a function of water content. Furthermore, the control devices 100 can be distributed along a section of a production well to provide fluid control at multiple locations. This can be advantageous, for example, to equalize production flow of oil in situations wherein a greater flow rate is expected at a "heel" of a horizontal well than at the "toe" of the horizontal well. By appropriately configuring the production control devices 100, such as by pressure equalization or by restricting inflow of gas or water, a well owner can increase the likelihood that an oil bearing reservoir will drain efficiently. Exemplary devices for controlling one or more aspects of production are discussed herein below.

In one embodiment, the production control device 100 includes a particulate control device 110 for reducing the amount and size of particulates entrained in the fluids, a flow control device 120 that controls overall drainage rate from the formation, and an in-flow control device 130 that controls the rate or amount of flow area based upon the presence of water content fluid in a flowing fluid. The particulate control device 110 can include known devices such as sand screens and associated gravel packs. After water of sufficient quantity flows through the production control device 100, the in-flow control device 130 actuates a flow control element 122 that is configured to restrict fluid flow into the flow bore 102.

Figure 4:
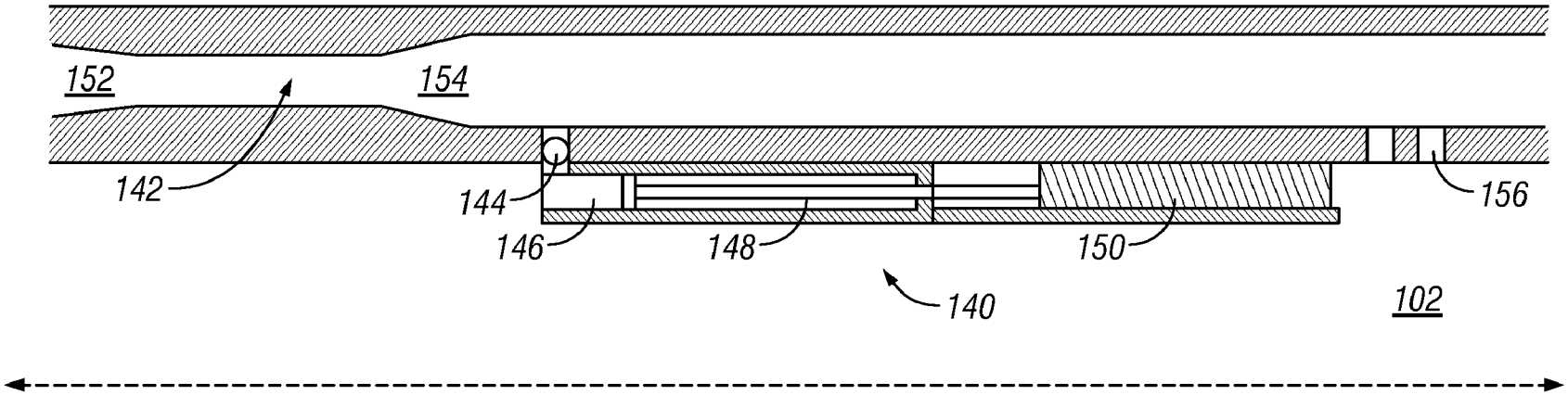
FIG. 4 is a side schematic view of an in-flow control device that generates cavitations in water flow in accordance with one embodiment of the present disclosure.

Referring now to FIG. 4, there is shown in schematic format one embodiment of an in-flow control device 140 that may be used to control flow of a fluid into a flow bore 102 of a wellbore tubular, such as a tubing 22 (FIG. 1). The in-flow control device 140 may include one or more venturi passages 142, a valve 144 that controls fluid communication with a pressure chamber 146, and a piston assembly 148 that actuates a closure member 150. While a venturi passage will be discussed in the present disclosure, it should be understood that the venturi passage is merely representative of a class of fluid passages that are configured to accelerate and decelerate a fluid under specified conditions to cause cavitations. The in-flow control device 140 may be constructed as a ring that fits around a wellbore tubular and that is positioned down stream of the particulate control device 110 (FIG. 3), such as the position generally shown by element 122 (FIG. 3). One or more of the venturi passages 142 may be circumferentially arrayed around the ring. While the closure member 150 is shown as a sliding sleeve-type element, other devices such as a choke, poppet valve, a throttle, or any similar device configured to partially or completely restrict flow may be utilized.

The venturi passage 142 may include a converging portion 152 and a diverging portion 154. The venturi passage 142 may be constructed to induce cavitations in the vicinity of the diverging portion 154 for a given amount of water content flowing through the passage 142 and for a given flow rate. The dimensions that may be varied to induce cavitations include the diameters of one or more passages, the length and slope angles of the portions 152, 154 and the number of venturi passages 142 provided in the in-flow control device 140. When the appropriate flow conditions exist, the pressure drop in the converging portion 152 causes voids or bubbles to emerge in the flowing fluid. That is, because fluid pressure is reduced significantly below the saturated vapor pressure of the water being produced, the fluid begins to cavitate, which causes voids or bubbles to emerge in the flowing fluid. Once these voids or bubbles enter the diverging portion 154, the sudden higher pressure in the diverging portion 154 causes the voids or bubbles to collapse. The collapse of these bubbles can create high pressure shock waves, which is conventionally referred to as cavitations, and which can be harnessed to energize or activate flow control devices as described in detail below. The surfaces of the venturi passage 142 may be treated or coated with materials that are resistant to damage, such as corrosion, erosion, or pitting, that may be associated with these cavitations.

The valve 144 and the pressure chamber 146 cooperate to capture and store the energy carried by the cavitations. In one arrangement, the valve 144 is configured as a one way valve that provides selective fluid communication between the diverging portion 154 and the pressure chamber 146 at or above a predetermined pressure. Over time, the pressure waves associated with the cavitations increase the pressure in the chamber 146. Once the pressure in the chamber 146 reaches a predetermined value, the built-up pressure displaces the piston assembly 148, which in turn actuates the closure member 150. For example, the piston assembly 148 may slide the closure member 150 over the openings 156 through which fluid flows into the flow bore 102. The piston assembly 148 may include biasing elements or restraining elements that are constructed to permit movement of the piston assembly 148 only after a predetermined pressure has been reached in the pressure chamber 146. For example, a biasing element such as a spring (not shown) or a pressurized gas may be used to oppose the pressure in the pressure chamber 146. Alternatively, or in addition to a biasing member, the piston assembly 148 may include shear pins, detent mechanisms and other like mechanisms that are calibrated to release upon being subjected to a predetermined pressure or force.

In one mode of use, a hydrocarbon or fluid made up of mostly hydrocarbons flows through the venturi passages 142 and into the flow bore 102 via the openings 156. Due to the vapor pressure and other properties of such fluids, no cavitations occur in the venturi passages 142. At some point, water coning or other condition may cause water to flow through the venturi passages 142. If the velocity of such water flow is of sufficient magnitude, then cavitations may be generated in the diverging portion 154. In response, the valve 144 opens to permit fluid or hydraulic communication between the diverging portion 154 and the pressure chamber 146. Once the pressure in the pressure chamber 146 reaches a predetermined value, the piston assembly 148 slides the closure member 150 to block flow across the openings 156. Thus, the flow of water, or a fluid made up of an undesirable amount of water, is prevented from entering the flow bore 102. In certain embodiments, the closure member 150 may be resettable. That is, a setting tool (not shown) may be run through the flow bore 102 to engage and move the closure member 150 to an open position. In other embodiments, one or more biasing elements in the piston assembly 148 return the closure member 150 to the open position once pressure drops in the passage 142. For instance, the closure member 150 may be configured to allow a limited amount of fluid flow across the openings 156. Thus, in the event water production dissipates, the biasing element may push or displace the piston assembly 148 in a manner that causes the closure member 150 to return to the open position.

Figure 5:
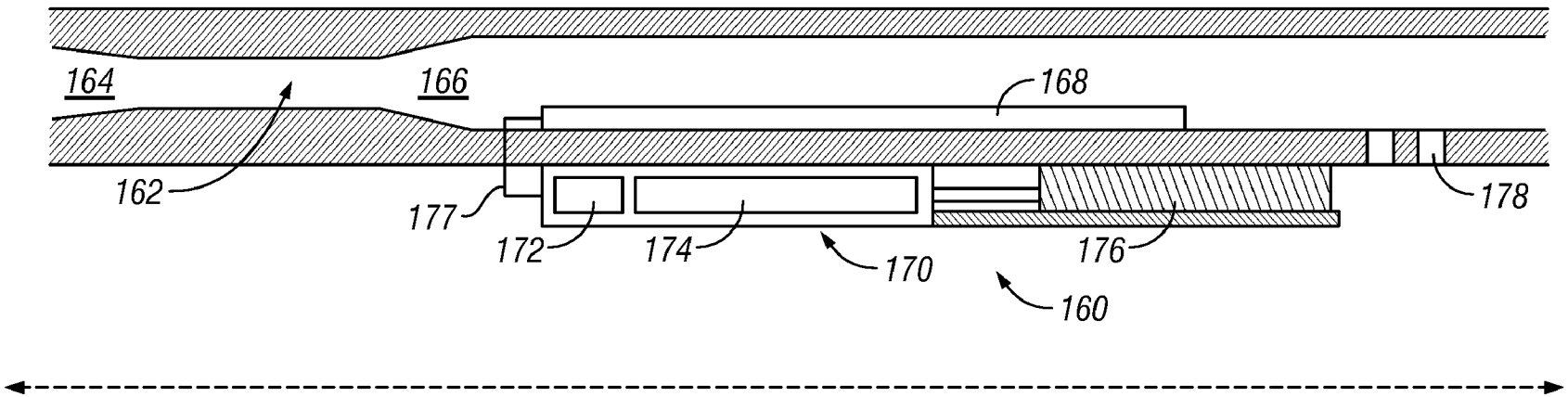
FIG. 5 is a side schematic view of another in-flow control device that generates cavitations in water flow in accordance with one embodiment of the present disclosure.

Referring now to FIG. 5, there is shown another embodiment of an in-flow control device 160 according to the present disclosure that also uses one or more venturi passages 162. The venturi passage 162 includes a converging portion 164 and a diverging portion 166. The venturi passage 162 may be constructed to induce cavitations in the vicinity of the diverging portion 166 in a manner previously described. To harness the energy associated with the cavitations, the in-flow control device 160 may include a power generator 168 and an electrically activated valve 170. The power generator 168 may be configured to generate electrical power using elements such as a piezoelectric stack. For example, the cavitations may vibrate the power generator 168, which deforms the piezoelectric elements. This physical deformation causes the piezoelectric elements to generate electrical signals that may be used to directly or indirectly activate the electrically activated valve 170. Other embodiments for power generators may include flow driven turbine generators.

In one arrangement, the electrically activated valve 170 includes a power storage device 172 such as a capacitor, a solenoid element 174 and a flow control element 176. Power may be conveyed from the power generator 168 to the electrically activated valve 170 via a line 177. Once a preset voltage is reached in the power storage device 172, the energy is released to energize the solenoid element 174, which then actuates the flow control element 176 to shut off fluid flow across the openings 178. In this arrangement, the power generated by the power generator 168 may be considered to directly activate the electrically activated valve 170.

Figure 6:
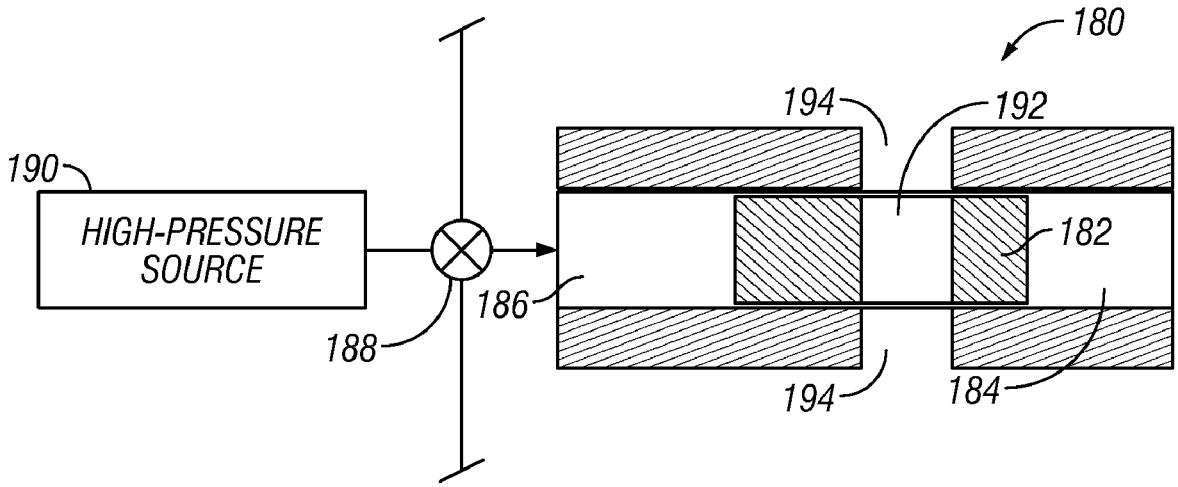
FIG. 6 is a schematic of a flow control device made in accordance with the present disclosure that may be used with the FIG. 5 embodiment.

Referring now to FIG. 6, there is shown another embodiment of a valve 180 that may be actuated using power generated by the downhole power generator 168 (FIG. 5). The valve 180 may be positioned to control fluid flow across the opening 178 (FIG. 5). The valve 180 may be configured as a piston 182 that translates within a cavity having a first chamber 184 and a second chamber 186. A flow control element 188 selectively admits a fluid from a high pressure fluid source 190 to the second chamber 186. The piston 182 includes a passage 192 that in a first position aligns with passages 194 to permit fluid flow through the valve 180. When the passage 192 and passages 194 are misaligned, fluid flow through the valve 180 is blocked. In one arrangement, the passages 192 and 194 are aligned when the chambers 184 and 186 have fluid at substantially the same pressure, e.g., atmospheric pressure. When activated by the downhole power generator 168 (FIG. 5), the flow control element 188 admits high pressure fluid from the high-pressure fluid source 190 into the second chamber 186. A pressure differential between the two chambers 184 and 186 translates the piston 182 and causes a misalignment between the passages 192 and 194, which effectively blocks flow across the valve 180. The high pressure fluid source 190 may be a high-pressure gas in a canister or a fluid in the wellbore. This arrangement may be considered an indirect activation in that the power generator 168 is used to generate a signal that releases a separate energy source to that is used to move the flow control element 176.

It should be understood that numerous arrangements may function as the flow control element 188. In some embodiments, the electrical power generated may be used to energize a solenoid. In other arrangements, the electric power may be used in connection with a pyrotechnic device to detonate an explosive charge. For example, the high-pressure gas may be used to translate the piston 182. In other embodiments, the electrical power may be use to activate a "smart material" such as magnetostrictive material, an electrorheological fluid that is responsive to electrical current, a magnetorheological fluid that is responsive to a magnetic field, or piezoelectric materials that responsive to an electrical current. In one arrangement, the smart material may be deployed such that a change in shape or viscosity can cause fluid to flow into the second chamber 186. Alternatively, the change in shape or viscosity can be used to activate the sleeve itself. For example, when using a piezoelectric material, the current can cause the material to expand, which shifts the piston and closes the ports.

It should be understood that FIGS. 1 and 2 are intended to be merely illustrative of the production systems in which the teachings of the present disclosure may be applied. For example, in certain production systems, the wellbores 10, 11 may utilize only a casing or liner to convey production fluids to the surface. The teachings of the present disclosure may be applied to control the flow into those and other wellbore tubulars.

For the sake of clarity and brevity, descriptions of most threaded connections between tubular elements, elastomeric seals, such as o-rings, and other well-understood techniques are omitted in the above description. Further, terms such as "valve" are used in their broadest meaning and are not limited to any particular type or configuration. The foregoing description is directed to particular embodiments of the present disclosure for the purpose of illustration and explanation. It will be apparent, however, to one skilled in the art that many modifications and changes to the embodiment set forth above are possible without departing from the scope of the disclosure.

What is claimed is:

1. An apparatus for controlling a flow of fluid between a wellbore tubular and a wellbore annulus, comprising:

a body;

a passage formed in the body, the passage being configured to cause cavitations in a fluid flowing through the passage; and a flow control device activated by the cavitations.

2. The apparatus according to claim 1 wherein the flow control device includes a pressure chamber; and a high-pressure fluid pressurized by the cavitations.

3. The apparatus according to claim 2 wherein the flow control device includes a valve opening in response to the cavitations.

4. The apparatus according to claim 2 wherein the flow control device includes a piston assembly actuated by a high pressure in the pressure chamber.

5. The apparatus according to claim 4 further comprising a closure element coupled to and displaced by the piston assembly.

6. The apparatus according to claim 1 wherein the passage includes a converging portion and a diverging portion.

7. The apparatus according to claim 1 further comprising a power generator configured to generate an electrical signal in response to the cavitations and transmit the electrical signal to the flow control device.

8. A method for controlling a flow of fluid between a bore of a wellbore tubular and a wellbore annulus, comprising:

(a) controlling fluid flow into the wellbore tubular bore using a flow control device; and (b) activating the flow control device using cavitations generated in a flowing fluid.

9. The method according to claim 8 further causing the cavitations using a passage between the wellbore tubular bore and the wellbore annulus.

10. The method according to claim 8 further comprising increasing a pressure in a pressure chamber using the cavitations.

11. The method according to claim 10 further comprising controlling the pressure in the pressure chamber using a valve that opens in response to the cavitations.

12. The method according to claim 10 further comprising actuating a piston assembly using a fluid in the pressure chamber that is pressurized by the cavitations.

13. The method according to claim 12 further comprising displacing a closure element coupled to the piston assembly.

14. The method according to claim 8 further comprising accelerating and decelerating a fluid flowing to the wellbore tubular to cause the cavitations.

15. The method according to claim 8 further comprising generating an electrical signal in response to the cavitations and transmitting the electrical signal to the flow control device.

16. A system for controlling a flow of fluid in a well, comprising:

(a) a wellbore tubular configured to convey fluid from a formation to surface location;

(b) an in-flow control device configured to control fluid flow between the formation and a bore of the wellbore tubular;

(c) a passage formed in the in-flow control device, the passage being configured to cause cavitations in a fluid flowing through the passage; and (d) a flow control device configured to control fluid flow across one or more openings into the wellbore tubular bore, the flow control device being energized by the cavitations.

17. The system according to claim 16 wherein the passage includes a first portion configured to accelerate a flowing fluid and a second portion configured to decelerate the flowing fluid.

18. The system according to claim 16 wherein the flow control device includes a pressure chamber configured to receive a high-pressure fluid associated with the cavitations; a piston assembly actuated by a high pressure in the pressure chamber; and a closure member displaced by the piston assembly.

19. The system according to claim 16 wherein the passage is configured to cause cavitations when the flowing fluid is substantially water and to not cause cavitations when the flowing fluid is substantially a hydrocarbon.

20. The system according to claim 16 further comprising a power generator configured to generate an electrical signal in response to the cavitations and transmit the electrical signal to the flow control device.

* * * * *